US006049047A

United States Patent [19]

Miyashima et al.

[11] Patent Number: 6,049,047

[45] Date of Patent: Apr. 11, 2000

[54] ELECTRONIC COMPONENT HAVING CONTACT INTEGRATED TYPE TERMINAL

[75] Inventors: Takahiro Miyashima, Okayama; Koji Tamano; Hiroshi Matsui, both of Osaka, all of Japan

[73] Assignee: Matsushita Electric Industrial Co., Ltd., Osaka, Japan

[21] Appl. No.: 08/833,209

[22] Filed: Apr. 14, 1997

[30] Foreign Application Priority Data

Apr. 16, 1996 [JP] Japan ..... 8-093989

[51] Int. Cl.[7] ..... H01H 1/02

[52] U.S. Cl. ..... 200/284; 200/16 A; 200/406

[58] Field of Search ..... 200/16 R–16 D, 200/402–408, 512, 516, 520, 238, 239, 267, 268, 275, 278, 284, 311

[56] References Cited

U.S. PATENT DOCUMENTS

| | | | |
|---|---|---|---|
| 3,548,131 | 12/1970 | Piber | 200/67 |
| 3,612,793 | 10/1971 | Roeser | 200/67 B |
| 4,385,218 | 5/1983 | Nishida | 200/159 B |
| 4,496,806 | 1/1985 | Maenishi et al. | 200/16 R |
| 5,013,266 | 5/1991 | Murphy et al. | 439/741 |
| 5,198,793 | 3/1993 | Levegue | 338/172 |
| 5,276,283 | 1/1994 | Ballentine et al. | 200/19 DC |
| 5,345,051 | 9/1994 | Miike | 200/345 |
| 5,634,552 | 6/1997 | Soberski | 200/284 |

*Primary Examiner*—Michael Friedhofer
*Attorney, Agent, or Firm*—McDermott, Will & Emery

[57] ABSTRACT

To present an electronic component including a contact integrated type terminal having a terminal portion with excellent mechanical strength and solderability and a contact portion with excellent contact characteristic. It comprises a contact integrated type terminal made of metal having a contact portion formed at one end and a terminal portion formed at other end, a case fixing the contact integrated type terminal, a movable contact placed in the case so as to cover the contact portion, and an operation member for operating the movable contact. The contact integrated type terminal includes a plated layer having solderability and conductivity at least on one side thereof, the terminal portion has a folded and overlaid shape so that the plated layer comes to the outside surface, the terminal portion can be soldered to a wiring board, the contact portion has the plated layer installed at the same side as the one side, and the movable portion contacts with the contact portion by operating the operation member so as to conduct with each other electrically.

10 Claims, 5 Drawing Sheets

ELECTRONIC COMPONENT HAVING CONTACT INTEGRATED TYPE TERMINAL

TECHNICAL FIELD OF THE INVENTION

The present invention relates to an electronic component having a contact integrated type terminal connected to a wiring board or the like by soldering for use in various electronic appliances.

BACKGROUND OF THE INVENTION

Usually, a small electronic component having a contact includes a contact integrated type terminal having a contact portion at one end, and a terminal portion at other end. In such constitution, a structure for picking up a signal directly from the contact portion is widely employed. The prior art of electronic component having such contact integrated type terminal is explained in an example of push switch by referring to FIG. 5.

In FIG. 5, a contact integrated type terminal 122 is attached to the bottom of a box-shaped case 121 made of molded resin by insert molding. A fixed contact portion 122A of the contact integrated type terminal 122 is exposed to the outside position of the bottom of the case 121, and a terminal portion 122B is projected outside of the case 121. A fixed contact portion 126A of other contact integrated type terminal 126 is exposed to the middle position of the bottom of the case 121, and a terminal portion 126B is projected outside of the case 121. These fixed contact portions 122A, 126A are disposed to keep a specific distance, and the contact integrated type terminal 122 and other contact integrated type terminal 126 are mutually in an electrically isolated state. From above the opening of the case 121, a dome-shaped movable contact 123, and an operation button 124 are inserted, and a cover 125 to conceal the opening of the case 121 is provided. At this time, the lower outer circumference of the dome-shaped movable contact 123 is put on the fixed contact portion 122A of the contact integrated type terminal 122, and the movable contact 123 and the fixed contact portion 122A of the contact integrated type terminal 122 are mutually in an electrically connected state.

Recently, this assembling process is fully automated from the first step. Generally, a hoop shaped thin metal plate is set in the machine, and is continuously processed from blanking step to inserting step, and the contact integrated type terminal 122 is assembled.

In the push switch, generally, terminals 122B, 126B are inserted into penetration holes formed in a wiring board or the like, and connected and fixed by soldering.

In the contact integrated type terminals 122, 126 of the conventional push switch, however, the contact portions 122A, 126A require plating on the surface side, but do not require plating on the back side. Moreover, a large plate thickness is not needed in the contact portions 122A, 126A. The terminal portions 122B, 126B require a large plate thickness in order to prevent deformation when mounting on the wiring board, and to assure strength after mounting. Still more, when the contact integrated type terminals 122, 126 are manufactured by blanking process by using a hoop shaped metal thin plate, since the fracture section of the metal thin plate is poor in solderability, it was required that both surface and back sides of the metal thin plate be treated with plating of excellent solderability. As a result, using a metal plate having a large plate thickness and plated on both surface and back sides, the contact integrated type terminals 122, 126 were manufactured. Hence, the cost was high.

On the other hand, to cope with such problem, it was also proposed to use a metal plate partially plated on both sides, but in this case the cost was similar to the conventional metal plate plated on both sides, and it was not effective solving means.

It is hence an object of the invention to solve such problems of the prior art, and present an electronic component having a contact integrated type terminal capable of guaranteeing the mechanical strength and solderability of the terminal portion.

SUMMARY OF THE INVENTION

The electronic component having a contact integrated type terminal of the invention comprises a contact integrated type terminal made of metal having a contact portion formed at one end and a terminal portion formed at other end, and a case fixing the contact integrated type terminal. The contact integrated type terminal includes a functional layer having solderability and conductivity at least on one side thereof, the terminal portion has a folded and overlaid shape so that the functional layer comes to the outside surface, having a double thickness of the metal plate, the terminal portion can be soldered, the contact portion has the functional layer installed at the same side as the one side, and the functional layer of the contact portion can contact with other contact member.

Preferably, the functional layer is a plated layer. Preferably, the case is a molded body of resin, and the portion between the terminal portion and the contact portion is fixed to the case. Preferably, it further comprises a movable contact placed in the contact portion so as to be free to contact with and depart from, and an operation member for operating the movable contact. The other contact member is the movable contact, the movable contact is moved by operating the operating member, and the functional layer and the movable contact of the contact portion conduct with each other electrically.

In this constitution, the contact integrated type terminal is half the thickness of the conventionally used metal plate, and a metal plate having a plated layer on one side can be used. Hence, the cost is notably lowered. Moreover, since the terminal is formed in a double thickness by folding over, the mechanical strength is sufficiently assured. Further, the terminal portion is folded over so that the plated layer comes to the outside, and the plated layer is formed on both surface and back sides, so that the solderability with the wiring board is sufficiently maintained and extremely enhanced. Depending on the desired shape of the contact portion, the folding center is designed, and the surface area of the metal plate can be effectively utilized, and the metal plate yield is extremely improved, and the manufacturing cost is lowered. Aside from the above performance, an excellent contact characteristic is obtained at the same time.

In the constitution, preferably, the folded center line of the terminal portion forms a notch, and the terminal portion is folded over along the notch. In this constitution, therefore, spring-back of the folded end is decreased. Still more, the manufacturing by folding process is extremely easy, and the manufacturing cost is extremely lowered.

Preferably, the folded center line of the terminal portion is positioned at the leading end of the terminal portion of the contact integrated type terminal, and the terminal portion has a folded shape in the direction of the contact portion of the contact integrated type terminal. In this constitution, when fabricating a contact integrated type terminal having the width of the terminal portion nearly same or slightly smaller as compared with the width of the contact portion, the surface area of the metal plate being used can be effectively utilized, and the yield of use of the metal plate is enhanced. In addition, since the leading ends of the terminal portions are continuous by bending, it is easy to insert into holes in the wiring board.

Preferably, the folded center line of the terminal portion is positioned at a side surface of the terminal portion of the contact integrated type terminal, and the terminal portion has a folded shape in the lateral direction of the contact integrated type terminal. In this constitution, when manufacturing a contact integrated type terminal having the width of the terminal portion smaller than the width of the contact portion, it is possible to utilize the surface area of the metal plate to be used effectively, and the yield of use of the metal plate is extremely enhanced. Still more, since the rate of the end portion of the coupling portion being continuous by folding is high, the overlaid density after folding is high, and the composition of the terminal portion is stable.

Preferably, the folded center line of the terminal portion is positioned at both side surfaces of the terminal portion of the contact integrated type terminal, and the terminal portion has a shape folded in the lateral direction from both sides of the contact integrated type terminal, with the leading ends of folded two portions facing end to end. In this constitution, an extremely excellent solderability is obtained, and occurrence of distortion or the like when bending and processing the terminal portion is prevented.

More preferably, the electronic component having a contact integrated type terminal of the invention comprises a first contact integrated type terminal made of metal having a first contact portion formed at one end and a first terminal portion formed at other end, a second contact integrated type terminal made of metal having a second contact portion formed at one end and a second terminal portion formed at other end, a case fixing the first contact integrated type terminal and the second contact integrated type terminal, a movable contact placed in contact on the first contact portion in the case so as to cover the second contact portion, and an operation member for operating the movable contact, wherein each one of the first contact integrated type terminal and the second contact integrated type terminal includes a plated layer having solderability and conductivity at least on one side thereof, each one of the first terminal portion and the second terminal portion has a folded and overlaid shape so that the plated layer comes to the outside surface, each one of the first terminal portion and second terminal portion is solderable to other electronic component, each one of the first contact portion and the second contact portion has the plated layer placed at the same side as the one side, the second contact portion can contact with the movable contact, and the movable contact contacts with the first contact portion and the second contact portion by operating the operation member so that the first contact integrated type terminal and the second contact integrated type terminal conduct with each other electrically.

In this constitution, the push switch having the above effects is obtained.

BRIEF DESCRIPTION OF THE DRAWINGS

FIG. 2(*b*) is a side view of a completed product of the contact integrated type terminal obtained by folding the metal plate in blanked state shown in FIG. 2(*a*).

FIG. 3(*b*) is a side view of a completed product of the contact integrated type terminal obtained by folding the metal plate in blanked state shown in FIG. 3(*a*).

DESCRIPTION OF THE PREFERRED EMBODIMENTS

Figure 1:
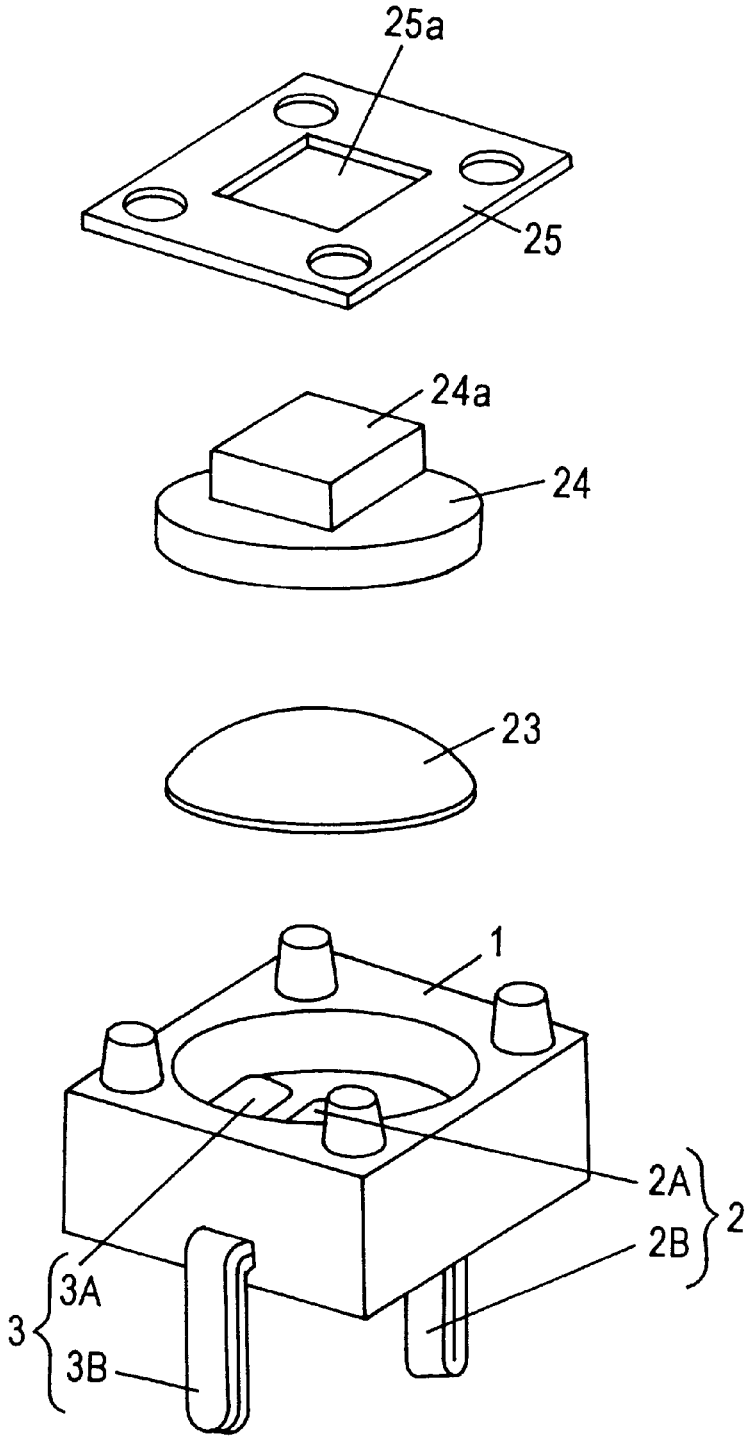
FIG. 1 is a perspective exploded view of a push switch showing an example of an electronic component having a contact integrated type terminal in an embodiment of the invention.

Referring now to the drawings, preferred embodiments of the invention are described below.

Embodiment 1

Figure 2A:
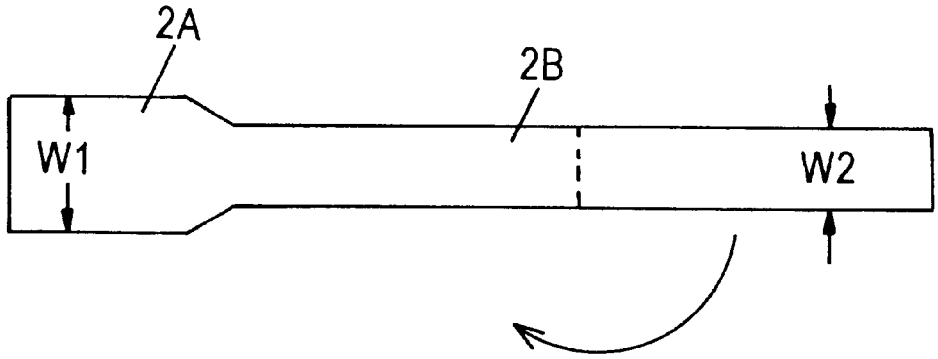
FIG. 2(*a*) is a plan view showing the state of fabrication by blanking of a contact integrated type terminal of an electronic component having contact integrated type terminal in an embodiment of the invention, more particularly showing the state of blanking of a contact integrated terminal having the width of the terminal portion same or slightly smaller as compared with the width of the contact portion.
Figure 2B:
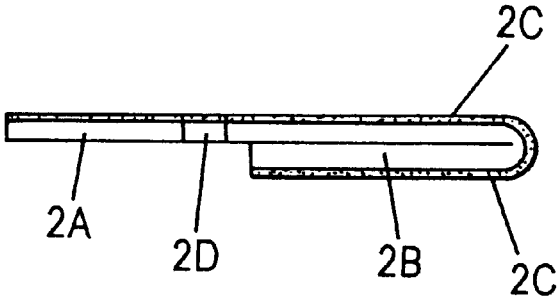
Figure 3A:
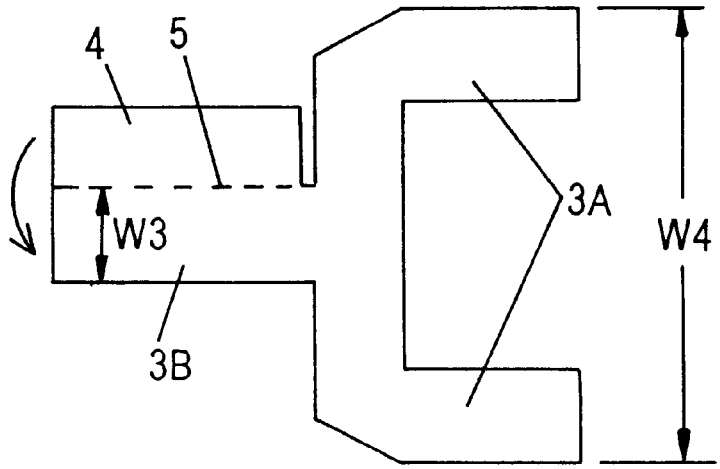
FIG. 3(*a*) is a plan view showing the state of fabrication by blanking of a contact integrated type terminal of an electronic component having contact integrated type terminal in an embodiment of the invention, more particularly showing the state of blanking of a contact integrated terminal having the width of the terminal portion extremely smaller than the width of the contact portion.
Figure 3B:
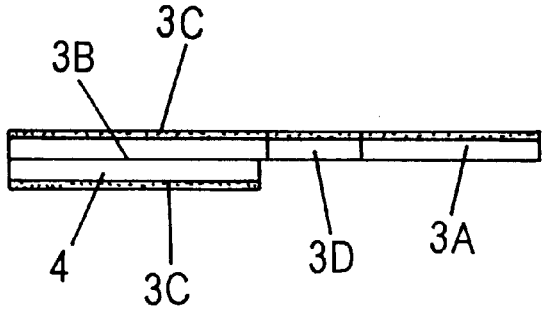

FIG. 1 is a perspective exploded view of a push switch showing an example of an electronic component having a contact integrated type terminal in an embodiment of the invention. FIG. 2(*a*) is a plan view showing the state of fabrication by blanking of a contact integrated type terminal of an electronic component having contact integrated type terminal in an embodiment of the invention, more particularly showing the state of blanking of a contact integrated terminal having the width of the terminal portion same or slightly smaller as compared with the width of the contact portion. FIG. 2(*b*) is a side view of a completed product of the contact integrated type terminal obtained by folding the metal plate in blanked state shown in FIG. 2(*a*). FIG. 3(*a*) is a plan view showing the state of fabrication by blanking of a contact integrated type terminal of an electronic component having contact integrated type terminal in an embodiment of the invention, more particularly showing the state of blanking of a contact integrated terminal having the width of the terminal portion extremely smaller than the width of the contact portion. FIG. 3(*b*) is a side view of a completed product of the contact integrated type terminal obtained by folding the metal plate in blanked state shown in FIG. 3(*a*).

In FIG. 1, the push switch comprises a first contact integrated type terminal 2, a second contact integrated type terminal 3, a box-shaped case 1, a dome-shaped movable contact 23, an operation button 24, and a cover 25. The first contact integrated type terminal 2 and second contact integrated type terminal 3 are manufactured by blanking a metal plate. The metal plate is not particularly limited, but a hoop-shaped metal plate is preferred. The metal plate to be used includes a plated layer as a functional layer having excellent conductivity and solderability placed on the surface of one side. That is, the metal plate in blanked state of the first contact integrated type terminal 2 has a first plated layer 2C placed on the surface of its one side. The metal plate in blanked state of the second contact integrated type terminal 3 has a second plated layer 3C placed on the surface of its one side. The first contact integrated type terminal 2 has a first fixed contact portion 2A at one side, and a first terminal portion 2B at other end. The first terminal portion 2B is folded and overlaid so that the first plated layer 2C may come to the outside. The second contact integrated type terminal 3 has a second fixed contact portion 3A at one side, and a second terminal portion 3B at other end. The second terminal portion 3B is folded and overlaid so that the second plated layer 3C may come to the outside. The first contact integrated type terminal 2 and the second contact integrated terminal 3 are fixed in the box-shaped case 1 formed by insert molding by using resin material.

The first fixed contact portion 2B and second fixed contact portion 3B are disposed so that the first plated layer 2C and second plated layer 3C may be at the upper side in the position not contacting with each other in the box-shaped case 1 The first terminal portion 2A and second terminal portion 3A are disposed so that each leading end may project to the lower side of the case 1. The dome-shaped movable contact 23 is mounted in contact on the first fixed contact portion 2A with the convex part at the upper side, and is placed in the case 1 so as to cover the second fixed contact portion 3A. The operation button 24 is disposed at the upper side of the dome-shaped movable contact 23. The cover 25 has an opening 25*a* corresponding to the shape of the convex part 24*a* of the operation button 24, and the cover 25 is disposed and fixed at the upper side of the case 1, so that the convex part 24*a* may be exposed from its opening. The dome shaped movable contact 23 has a conductive surface.

In this constitution, when the operation button 24 is pressed, the dome-shaped movable contact 23 placed on the first fixed contact portion 2A is inverted to contact with the second fixed contact portion 3A. As a result, the first fixed contact portion 2A of the first contact integrated type terminal 2 and the second fixed contact portion 3A of the second contact integrated type terminal 3 conduct with each other electrically. In this way, by pressing the operation button 24, the first contact integrated type terminal 2 and second contact integrated type terminal 3 conduct with each other.

The prototype of the first contact integrated type terminal 2 blanked by using a metal plate is shown in FIG. 2(*a*). In the first contact integrated type terminal 2, the width W2 of the terminal portion 2B is nearly same or slightly narrower as compared with the width W1 of the fixed contact portion 2A. As shown in FIG. 2(*a*), the terminal portion 2B is formed by blanking so that the portion to be the terminal portion 2B may be twice the required terminal length, and folding over and overlaying from the middle of the blanked terminal portion so that the first plated layer 2C may come to the outside. The section of the overlaid terminal portion 2B is shown in FIG. 2(*b*). That is, the terminal 2B has a thickness of about twice the fixed contact portion 2A. Moreover, the contact portion 2B has the first plated layer 2C in both surface and back sides. Nearly the middle portion 2D of the contact portion 2A and terminal portion 2B is fixed to the case 1.

The prototype of the second contact integrated type terminal 3 blanked by using a metal plate is shown in FIG. 3(*a*). The fixed contact portion 3A of the second contact integrated type terminal 3 is branched into two sections, and the maximum width W4 of the branched shape is extremely larger than the width W3 of the terminal portion 3B. That is, the width of the terminal 3B is extremely smaller than the overall width of the contact portion 3B. As shown in FIG. 3(*a*), a folding portion 4 is formed at the lateral side of the terminal portion 3B, and further, for the ease of folding, a discontinuous hole or notch 5 is formed along the folding center line of the terminal portion 3B, and folding over and overlaying from the middle of the notch 5 so that the second plated layer 3C may come to the outside, thereby forming the terminal portion 3B. The section of the overlaid terminal portion 3B is shown in FIG. 3(*b*). That is, the terminal 3B has a thickness of about twice the fixed contact portion 3A. Moreover, the contact portion 3B has the second plated layer 3C in both surface and back sides. Nearly the middle portion 3D of the contact portion 3A and terminal portion 3B is fixed to the case 1.

In this constitution, each one of the first contact integrated type terminal 2 and second contact integrated terminal 3 is half the thickness of the conventionally used metal plate, and at the same time the metal placing a plated layer on one side can be used. Hence the cost is extremely lowered. Still more, since each one of the first terminal portion 2B and second terminal portion 3B is formed in a double thickness by folding over, so that the mechanical strength is maintained sufficiently. Moreover, each one of the first terminal unit 2B and second terminal unit 3B has a plated layer on both surface and back sides, and the solderability to the wiring board is sufficiently assured. Depending on the desired shape of the contact portion, it is possible to design the folding center and use the surface area of the metal plate effectively, and therefore the yield of the metal plate is extremely enhanced, and the manufacturing cost is lowered.

Embodiment 2

Figure 4:
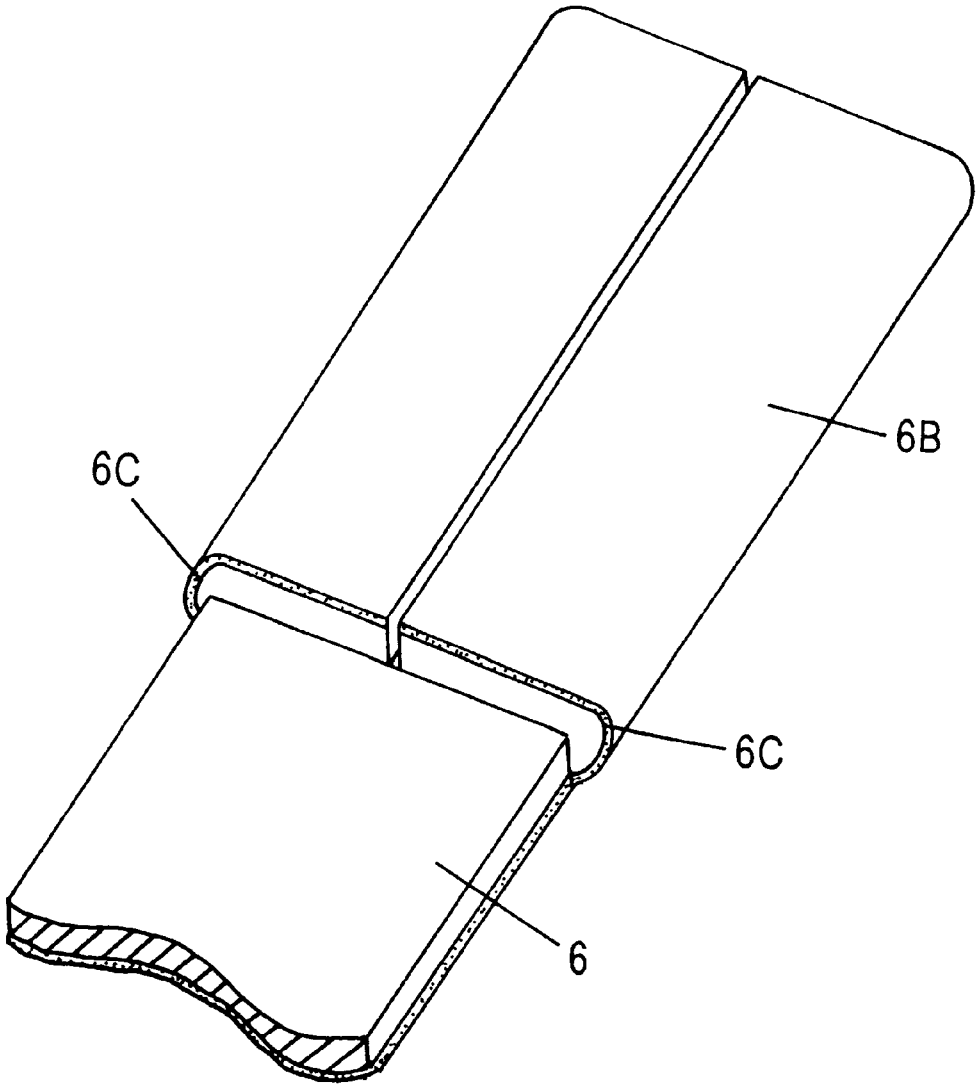
FIG. 4 is a partial perspective view of other contact integrated type terminal used in an electronic component having contact integrated type terminal in other embodiment of the invention.
Figure 5:
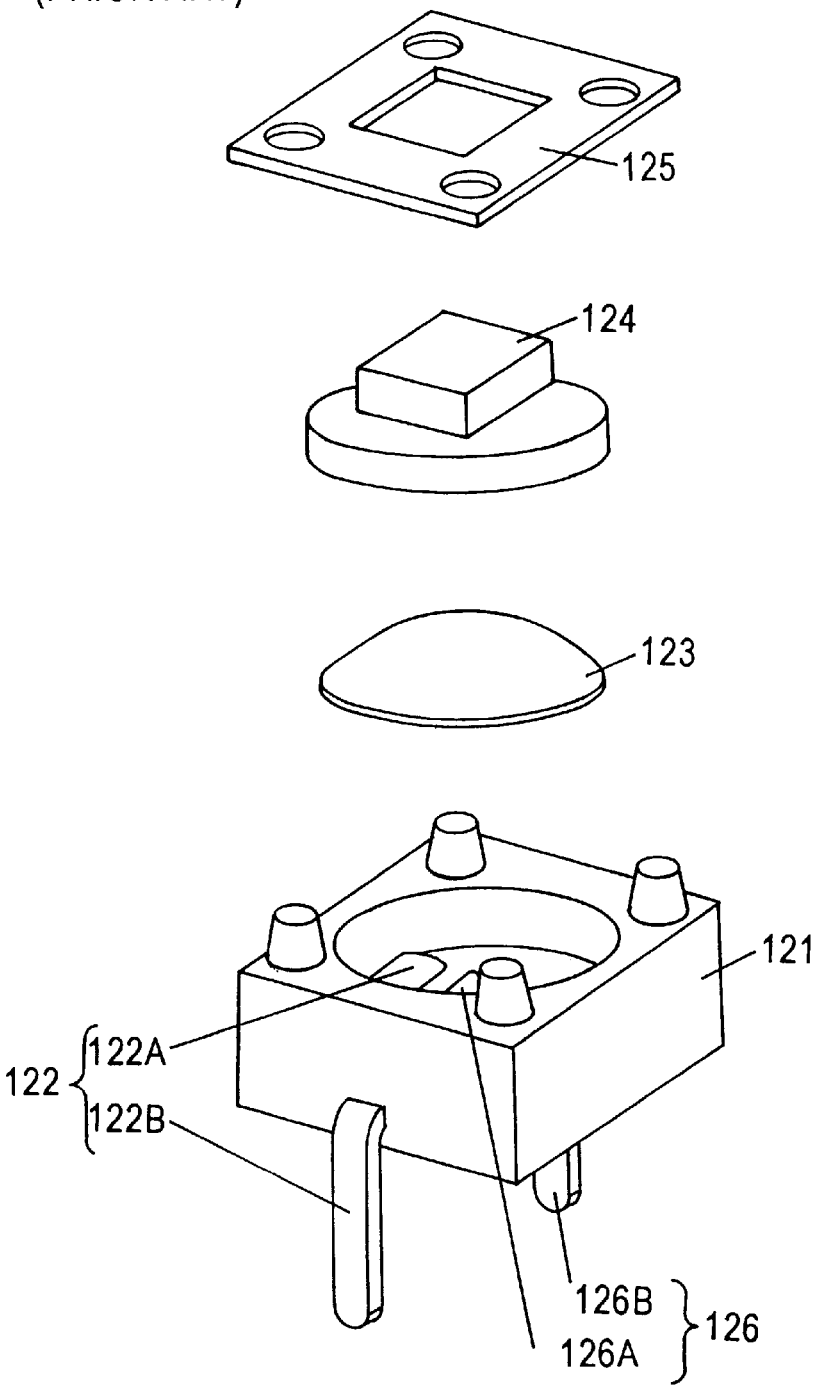
FIG. 5 (PRIOR ART)
FIG. 5 is a perspective exploded view of a push switch having contact integrated type terminal in prior art.

FIG. 4 is a perspective view of a part of the contact integrated type terminal of an electronic component having a contact integrated type terminal in other embodiment of the invention. In FIG. 4, a third terminal portion 6B of a first contact integrated type terminal 6 is formed by folding back the portions of both side surfaces of the terminal portion so that a third plated layer 6C may come to the outside, and setting each one of the leading ends of the folded both side portions face to face. The fixed contact portion (not shown) may be shaped as shown in FIG. 2 or FIG. 3. In this constitution, the plated layer 6C is exposed on the entire outer circumference of the terminal portion 6B. Hence, the solderability with the wiring board is further improved. Still more, the both side surfaces of the terminal portion are continuous with each other. Hence, when bending the terminal portion, distortion or the like may be prevented, and the subsequent process may be easier.

In the invention, as the functional layer, the plated layer is most preferred, but instead of the plated layer, a functional layer having conductivity and solderability may be disposed. As the functional layer, for example, a paint film, an evaporation film or a sputtering film may be used. The fixed contact portion of the contact integrated type terminal may have a flexible contact. The contact integrated type terminal may be fixed to the case by other fixing means such as rivet. Each one of the fixed contact portion and terminal portion of the contact integrated type terminal may have an arbitrary desired shape. Not limited to the push switch, the invention may be also applied to other electronic component including a contact integrated type terminal having integrally formed contact portion and terminal portion. For example, it is also applicable to an electronic component disposing only one contact integrated type terminal. In such constitution, the same effects as above are obtained. The contact integrated type terminal may have a plated layer on both sides, not limited to one side. In this case, however, the cost for disposing the plated layers may tend to be slightly increased, but other effects are same as above.

In the above constitution of the invention, the following effects are obtained.

(1) The contact integrated type terminal is half the thickness of the conventionally used metal plate, and a metal plate having a plated layer on one side can be used. Hence, the cost is notably lowered.

(2) Since the terminal is formed in a double thickness by folding over, the mechanical strength is sufficiently assured.

(3) The terminal portion is folded over so that the plated layer comes to the outside, and the plated layer is formed on both surface and back sides, so that the solderability with the wiring board is sufficiently maintained and extremely enhanced.

(4) Depending on the desired shape of the contact portion, the folding center is designed, and the surface area of the metal plate can be effectively utilized, and the metal plate yield is extremely improved, and the manufacturing cost is lowered.

(5) Aside from the above performance, an excellent contact characteristic is obtained at the same time.

(6) In particular, the terminal portion is formed by folding over the both side portions of the terminal portion so that the plated layer comes to the outside and setting the leading ends of the folded both side portions face to face, and therefore the plated layer is exposed on the entire surface of the outer circumference of the terminal portion, so that the solderability with the wiring board may be extremely enhanced. Further, since the both side surfaces of the terminal portion are continuous with each other, when bending and processing the terminal portion, occurrence of distortion or the like is prevented, and the later processing may be easier.

What is claimed is:

1. An electronic component having a contact integrated type terminal comprising:

a contact integrated type terminal made of metal having a contact portion formed at one end and a terminal portion formed at another end, and a case fixing said contact integrated type terminal, wherein said contact integrated type terminal includes a functional layer having solderability and conductivity at least on one side thereof, said terminal portion has a folded and overlaid shape so that said functional layer comes to an outside surface, said contact portion having said functional layer disposed on at least a portion thereof, and said functional layer of said contact portion can contact with other contact member.

2. An electronic component having a contact integrated type terminal of claim 1, wherein said functional layer is a plated layer.

3. An electronic component having a contact integrated type terminal of claim 1, wherein said case is a molded body of resin, and a portion between said terminal portion of said contact integrated type terminal and said contact portion is fixed to said case.

4. An electronic component having a contact integrated type terminal of claim 1, further comprising a movable contact placed in said contact portion so as to be free to contact with and depart from, and an operation member for operating said movable contact, wherein said other contact member is said movable contact, said movable contact is moved by operating said operating member, and said functional layer of said contact portion and said movable contact conduct with each other electrically.

5. An electronic component having a contact integrated type terminal of claim 1, wherein a folded center line of said terminal portion forms a notch, and said terminal portion is folded over along said notch.

6. An electronic component having a contact integrated type terminal of claim 1, wherein a folded center line of said terminal portion is positioned at a leading end of said terminal portion of said contact integrated type terminal, and said terminal portion has a folded shape in a direction of said contact portion of said contact integrated type terminal.

7. An electronic component having a contact integrated type terminal of claim 1, wherein a folded center line of said terminal portion is positioned at a side surface of said terminal portion of said contact integrated type terminal, and said terminal portion has a folded shape in a lateral direction of said contact integrated type terminal.

8. An electronic component having a contact integrated type terminal of claim 1, wherein a folded center line of said terminal portion is positioned at both side surfaces of said terminal portion of said contact integrated type terminal, and said terminal portion has a shape folded at said center lines in a lateral direction from said both side surfaces of said contact integrated type terminal, with the ends facing each other.

9. An electronic component having a contact integrated type terminal comprising:

a first contact integrated type terminal made of metal having a first contact portion formed at one end and a first terminal portion formed at another end, a second contact integrated type terminal made of metal having a second contact portion formed at one end and a second terminal portion formed at another end, a case fixing said first contact integrated type terminal and said second contact integrated type terminal, a movable contact placed in contact on said first contact portion in said case so as to cover said second contact portion, and an operation member for operating said movable contact, wherein each of said first contact integrated type terminal and said second contact integrated type terminal includes a plated layer having solderability and conductivity at least on one side thereof, each of said first terminal portion and said second terminal portion has a folded and overlaid shape so that said plated layer comes to an outside surface, said each of said first terminal portion and second terminal portion is solderable to another electronic component, said second contact portion can contact with said movable contact, and said movable contact contacts with said first contact portion and said second contact portion by operating said operation member so that said first contact integrated type terminal and said second contact integrated type terminal conduct with each other electrically.

10. An electronic component having a contact integrated type terminal of claim 9, wherein said movable contact is dome-shaped, said dome-shaped movable contact is inverted by pressing near a top of said dome shape, and thereby said movable contact contacts with said second contact portion, so that said first contact integrated type terminal and said second contact integrated type terminal may conduct with each other electrically.

* * * * *